US011781462B2

(12) United States Patent
Sauer et al.

(10) Patent No.: US 11,781,462 B2
(45) Date of Patent: Oct. 10, 2023

(54) MIXER

(71) Applicant: Friedrich Boysen GmbH & Co. KG, Altensteig (DE)

(72) Inventors: Stefan Sauer, Wildberg (DE); Bernd Burkhardt, Baiersbronn (DE); Andreas Haas, Dornstetten (DE)

(73) Assignee: Friedrich Boysen GmbH & Co. KG, Altensteig (DE)

( * ) Notice: Subject to any disclaimer, the term of this patent is extended or adjusted under 35 U.S.C. 154(b) by 484 days.

(21) Appl. No.: 16/791,041

(22) Filed: Feb. 14, 2020

(65) Prior Publication Data

US 2020/0263590 A1 Aug. 20, 2020

(30) Foreign Application Priority Data

Feb. 14, 2019 (DE) ..... 102019103780.8

(51) Int. Cl.

| | |
|---|---|
| ***F01N 3/28*** | (2006.01) |
| ***F01N 3/20*** | (2006.01) |
| ***B01F 23/213*** | (2022.01) |
| ***B01F 25/10*** | (2022.01) |
| ***B01F 25/421*** | (2022.01) |
| ***B01F 25/431*** | (2022.01) |

(52) U.S. Cl.

CPC ..... *F01N 3/2892* (2013.01); *B01F 23/213* (2022.01); *B01F 25/10* (2022.01); *B01F 25/4231* (2022.01); *B01F 25/4315* (2022.01); *F01N 3/2066* (2013.01); *F01N 2610/02* (2013.01)

(58) Field of Classification Search

CPC ..... B01F 2005/0017; B01F 2005/0639; B01F 3/04021; B01F 5/0057; B01F 5/0606; B01F 5/0616; F01N 2240/20; F01N 2610/02; F01N 3/2066; F01N 3/2892

See application file for complete search history.

(56) References Cited

U.S. PATENT DOCUMENTS

| | | | | |
|---|---|---|---|---|
| 1,113,041 | A | 10/1914 | Murphy | |
| 2013/0188444 | A1* | 7/2013 | Palmer | B01F 25/3141 366/337 |

(Continued)

FOREIGN PATENT DOCUMENTS

| | | | |
|---|---|---|---|
| DE | 102007009890 | A1 | 9/2008 |
| DE | 112014005413 | T5 | 8/2019 |

(Continued)

*Primary Examiner* — Phutthiwat Wongwian
*Assistant Examiner* — Diem T Tran
(74) *Attorney, Agent, or Firm* — Dickinson Wright PLLC

(57) ABSTRACT

A mixer for mixing an exhaust gas flow with a fluid injected into an exhaust gas line comprises means for generating a swirl effecting a rotating flow and means for a radial displacement in the exhaust gas flow admixed with the fluid and flowing axially through the mixer. In this respect, the swirl generation means and the radial displacement means are arranged and designed such that, viewed over the cross-section of the mixer perpendicular to the axial exhaust gas flow, at least two separate swirl regions result which are built up via tangentially acting vane-like swirl elements and at least one respective radial displacement region results which is arranged between two separate swirl regions.

26 Claims, 13 Drawing Sheets

(56) References Cited

U.S. PATENT DOCUMENTS

Figure 1:
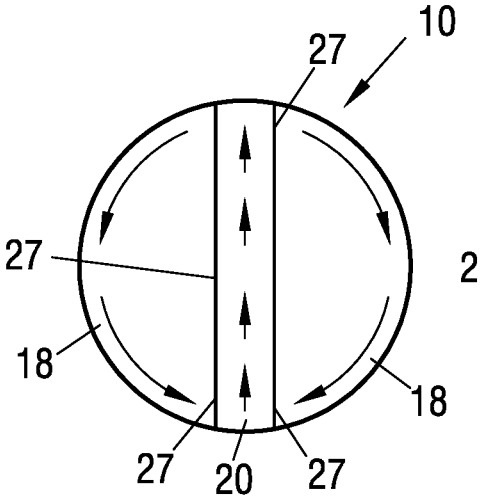

| | | | | |
|---|---|---|---|---|
| 2014/0102082 | A1* | 4/2014 | Tobben | F01N 3/2066 60/324 |
| 2015/0040547 | A1* | 2/2015 | Brockman | B01F 25/43151 60/324 |

FOREIGN PATENT DOCUMENTS

| | | | |
|---|---|---|---|
| EP | 2865861 | A1 | 4/2015 |
| WO | 2015080917 | A1 | 6/2015 |

* cited by examiner

Fig.11
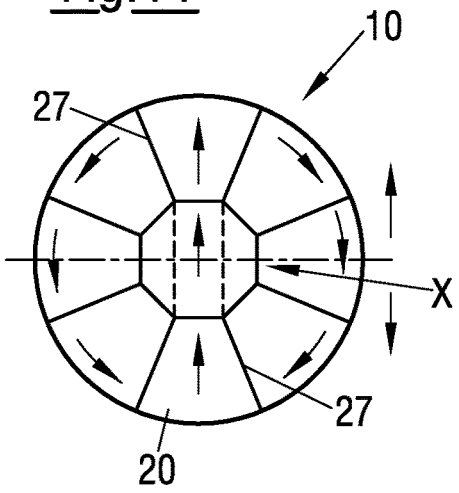
Fig.12
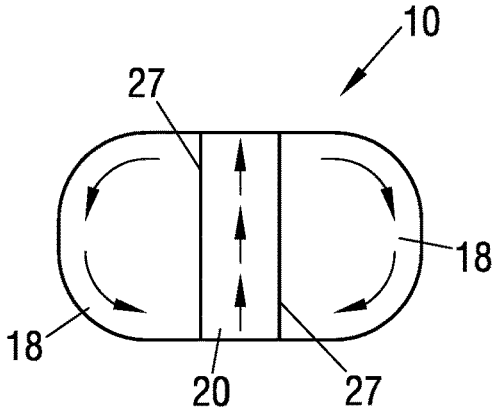
Fig.13
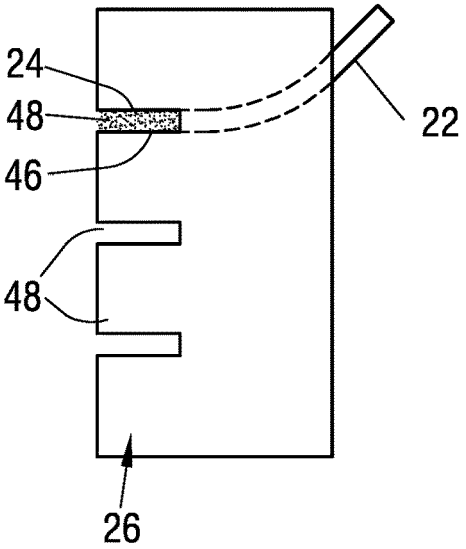
Fig.14
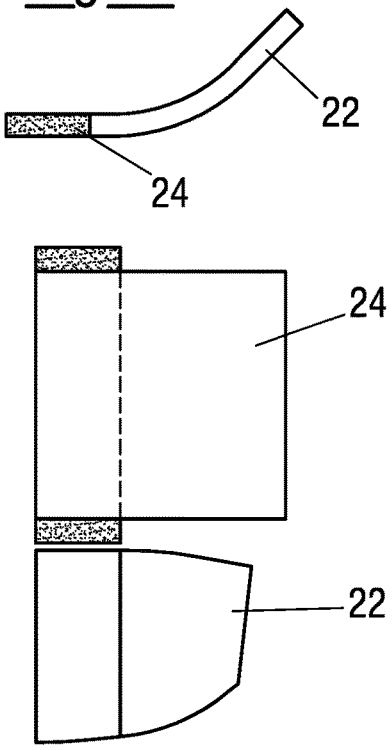
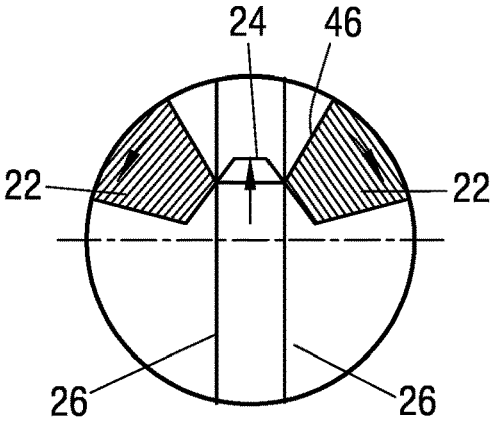
Fig.15

MIXER

CROSS-REFERENCES TO RELATED APPLICATIONS

This patent application claims the benefit of priority to German Patent Application No. 102019103780.8 filed Feb. 14, 2019, which are incorporated herein by reference in their entirety.

The invention relates to a mixer for mixing an exhaust gas flow with a fluid injected into an exhaust gas line.

The problem of evaporating and distributing a fluid reliably in a suitable form in a gas flow in order, for example, to enable a chemical reaction of components of the gas flow with components of the fluid to be evaporated is one which arises in many application areas. This problem arises in exhaust gas engineering, for example, in connection with the introduction of fuel as part of an HCl system or in connection with the SCR process in which an aqueous urea solution is, for example, introduced into the exhaust tract of a fuel by means of a metering pump and an injector. Ammonia and $CO_2$ result from the urea solution by thermolysis and hydrolysis. The ammonia produced in this manner can react in a suitable catalytic converter with the nitrogen oxides contained in the exhaust gas so that they are efficiently removed from the exhaust gas.

It is of particular relevance in the last-named process that the fluid or the urea solution is supplied in a suitable ratio to the nitrogen oxide quantity contained in the exhaust gas. It is moreover of great importance that the urea solution introduced into the exhaust gas flow is evaporated as completely as possible and is uniformly distributed in the exhaust gas flow. For this purpose, a mixer is frequently provided behind the introduction point of the fluid in the flow direction.

In exhaust gas systems close to the engine, the reductant, for example urea dissolved in water, must be distributed as homogenously as possible within the mixing path by the static mixer typically used. A static mixer is typically used for this purpose. However, the fluid spray cone is now scattered when the fluid is sprayed into the exhaust gas line flowed through by the exhaust gas, which is accompanied by the danger that the fluid sprayed in at least substantially only reaches the upper region and/or the lower region of the exhaust gas line. This problem in particular increasingly occurs at higher exhaust gas speeds. A mixer of the initially named kind is, for example, indeed already known from DE 11 2014 005 413 A in which the exhaust gas is urged radially upwardly and downwardly by horizontal metal sheets. However, the mixing and distribution effect achieved in so doing is still limited.

It is the underlying object of the invention to provide a mixer of the initially named kind which has a noticeably improved mixing and distribution effect compared to the previously customary mixers.

In accordance with the invention, this object is satisfied by a mixer having the features of claim 1. Preferred embodiments of the mixer in accordance with the invention result from the dependent claims, from the present description and from the drawing.

The mixer in accordance with the invention for mixing an exhaust gas flow with a fluid injected into an exhaust gas line comprises both means for generating a swirl effecting a rotating flow and means for a radial displacement in the exhaust gas flow admixed with the fluid and flowing axially through the mixer. In this respect, the swirl generation means and the radial displacement means are arranged and designed such that, viewed over the cross-section of the mixer perpendicular to the axial exhaust gas flow, at least two separate swirl regions result which are built up via tangentially acting vane-like swirl elements and at least one respective radial displacement region results which is arranged between two separate swirl regions.

Due to this configuration, a multi-swirl mixer results in which different regions arise, wherein a radial displacement takes place at the center of said multi-swirl mixer and tangential deflections of the exhaust gas admixed with the fluid take place at its margin to generate a respective swirl. In the mixing pipe arranged downstream, the multi-swirl generated effects a return of the sprayed-in fluid to the center of the mixing pipe. The radial displacement at the center assists the generation of the swirl since the radially outwardly displaced mixture has to flow to the left and to the right. Due to the corresponding division of the mixer into a plurality of regions, the fluid drops subsequent to the mixer are distributed into different regions. As a result, a more ideal mixing of the fluid and of the exhaust gas flow as well as a more ideal distribution of the fluid in the exhaust gas flow are thus achieved. In addition, the immediate and intensive mixing of the mixture achieved in accordance with the invention takes account of the circumstance that the swirl decreases with the run length of the mixture in the exhaust gas line.

The swirl generation means preferably comprise a plurality of swirl elements and/or the radial displacement means comprise a plurality of radial displacement elements.

At least some of the swirl elements and/or at least some of the radial displacement elements may be respectively supported or formed at a carrier element, in particular at a sheet metal carrier plate.

For strength reasons, it can be of advantage to support or to form some of the swirl elements and/or at least some of the radial displacement elements at a sheet metal carrier plate.

At least some of the swirl regions are preferably separated from one another by separation elements, in particular by sheet metal separation plates. In this respect, at least some of the separation elements can advantageously also be formed by the carrier elements.

In the installed state of the mixer, the separation elements or sheet metal separation plates can at least partly, in particular generally, be aligned in a perpendicular manner. They can also serve for the fixing of the sheet metal plates to one another in a carrier pipe or in the exhaust gas line. The carrier elements or sheet metal carrier plates are preferably arranged at the center of the mixer since the flow is weak here. The generation of the swirl is thus disrupted as little as possible by these carrier elements. It is in particular also of advantage if the carrier elements are at least substantially only arranged in the region of the mixer which is the front region, viewed in the direction of the exhaust gas flow, and in which no swirl is present yet.

In particular to maintain the swirl structure generated, at least some of the separation elements are advantageously axially extended beyond the swirl elements and the radial displacement elements. Alternatively or additionally, to maintain the swirl structure generated, the mixer can, for example, also comprise at least one separation element arranged downstream which is separate from the multi-swirl region and from the at least one radial displacement region.

As already stated, the swirl generation means are preferably arranged and designed such that a tangential deflection of the exhaust gas flow admixed with the fluid is radially outwardly generated in a respective swirl region.

A respective radial displacement region is advantageously arranged between adjacent swirl regions, viewed over the cross-section of the mixer perpendicular to the axial exhaust gas flow.

In accordance with an expedient practical embodiment of the mixer in accordance with the invention, the radial displacement means are arranged and designed such that at least two separate radial displacement regions result, viewed over the cross-section of the mixer perpendicular to the axial exhaust gas flow. The mixing and distribution effect is thereby further improved.

The mutually separate swirl regions and/or the separate radial displacement regions can in particular respectively be arranged with mirror symmetry or with point symmetry, viewed over the cross-section of the mixer perpendicular to the axial exhaust gas flow. In general, however, such embodiments are also conceivable in which the swirl regions and/or the radial displacement regions are arranged without symmetry.

In accordance with an advantageous embodiment, at least two mutually separate swirl regions are provided in which swirl is generated in opposite directions.

In this respect, at least one radial displacement region is expediently provided between the two mutually separate swirl regions generating swirl in opposite directions.

It is in particular also of advantage if at least two mutually separate swirl regions are provided which generate swirl in opposite directions and between which a radial displacement region is arranged which generates a radial displacement in one direction. Alternatively or additionally, such an embodiment is in particular also conceivable in which at least two mutually separate swirl regions are provided which generate swirl in opposite directions and between which two radial displacement regions are arranged which generate a radial displacement in opposite directions.

In accordance with a preferred further embodiment, four mutually separate swirl regions are provided, with swirl being generated in one direction by a pair of swirl regions disposed diagonally opposite one another, viewed over the cross-section of the mixer perpendicular to the axial exhaust gas flow, and with swirl being generated in the opposite direction by another pair of swirl regions disposed diagonally opposite one another, viewed over the cross-section of the mixer perpendicular to the axial exhaust gas flow.

It is in particular of advantage in this respect if two radial displacement regions are provided which are consecutive to one another in a radial direction, viewed over the cross-section of the mixer perpendicular to the axial exhaust gas flow, and which are each arranged between two swirl regions generating swirl in opposite directions. In this case, a radial displacement is generated in opposite directions in the two radial displacement regions consecutive to one another in the radial direction.

It is moreover of advantage if a first pair of radial displacement regions are provided which are consecutive to one another in a first radial direction, viewed over the cross-section of the mixer perpendicular to the axial exhaust gas flow, and a further pair of radial displacement regions are provided which are consecutive to one another in a further radial direction perpendicular to the first radial direction, viewed over the cross-section of the mixer perpendicular to the axial exhaust gas flow. In this respect, a radial displacement is preferably generated in opposite directions in the two radial displacement regions, which are consecutive to one another in a respective radial direction, of a respective pair of radial displacement regions.

It is in particular also of advantage if a respective radial displacement region of the two pairs of radial displacement regions is arranged between two swirl regions generating swirl in opposite directions.

For example, at least some of the swirl elements can be formed by a sheet metal swirl plate or by a sheet metal tangential plate and/or at least some of the radial displacement elements can be formed by a sheet metal radial plate.

The radial displacement elements can each comprise a base body having at least one radial displacement section serving for the radial displacement.

In this respect, in accordance with an expedient embodiment, the base body of at least some of the radial displacement elements is provided with only one respective radial displacement section which continuously generates a radial displacement, viewed in the direction of the axial exhaust gas flow, so that the respective radial displacement sections are designed in one stage. In contrast, in accordance with a further preferred embodiment of the mixer in accordance with the invention, the base body of at least some of the radial displacement elements is provided with at least two respective radial displacement sections which each continuously generate a radial displacement, viewed in the direction of the axial exhaust gas flow, wherein an intermediate section without radial displacement can be provided between a respective preceding radial displacement section and a respective subsequent radial displacement section. In the latter case, the respective radial displacement elements are thus designed in multiple stages, wherein they can in particular be designed in two stages.

The mixer can be jacketless or can also be provided with a jacket. In the latter case, the jacket can be at least partly produced by swirl elements or by individual metal sheets. Impressions can also be provided in the corresponding outer metal sheets to enable a welding on at the exhaust gas pipe or at the exhaust gas line. The outer part can be provided as a pipe or can be formed from half-shells. In a jacketless design, the mixer can in particular comprise two jacketless mixer halves which are advantageously fastened in the exhaust gas pipe in said manner.

In a respective design with a jacket, the jacket can in particular be at least substantially circular or oval in cross-section. In this respect, an oval design is above all favorable for double swirl guidance.

In accordance with an advantageous practical embodiment of the mixer in accordance with the invention, at least one pair of mutually oppositely disposed swirl elements is provided which forms a single-piece component with at least one radial displacement element arranged therebetween.

In this respect, a respective single-piece or stretched component comprising a pair of swirl elements and at least one radial displacement element arranged therebetween is at least partly supported at two adjacent carrier elements or sheet metal carrier plates by which the respective swirl regions and the respective at least one radial displacement region are separated from one another.

It is in particular also of advantage if a respective single-piece component comprising a pair of swirl elements and at least one radial displacement element arranged therebetween is at least partly supported at the two adjacent carrier elements or sheet metal carrier plates by at least sectionally engaging into slits provided in the carrier elements or sheet metal carrier plates.

In accordance with a further expedient embodiment of the mixer in accordance with the invention, the radial displacement means are arranged and designed such that at least one radial displacement region results, viewed over the cross-section of the mixer perpendicular to the axial exhaust gas flow, which is laterally offset with respect to a central plane extending in an axial direction.

The swirl elements are advantageously arranged and designed such that swirl regions having different swirl angles result.

In accordance with a preferred embodiment of the mixer in accordance with the invention, at least two adjacent swirl regions are separated from one another by two separation elements between which a radial displacement region is formed. In this respect, the two separation elements can be aligned in parallel with one another to bound a radial displacement region disposed therebetween which has a radially continuously unchanging width. Alternatively, such embodiments are, however, in particular also conceivable in which the two separation elements are arranged at a corresponding angle relative to one another to bound a radial displacement region disposed therebetween which continuously becomes wider in the radial direction.

In certain cases, it can also be of advantage if the number of carrier elements or sheet metal carrier plates is in particular equal to the number of swirl regions generated in the case of a point-symmetrical arrangement of the swirl elements and/or of the radial displacement elements.

In accordance with a further preferred practical embodiment, the mixer is designed in two parts in that it can be assembled or is assembled from two sheet metal parts which are correspondingly folded over or folded to form the swirl elements, the radial displacement elements and the carrier elements.

It is in particular also of advantage if the mixer is provided, in particular downwardly, viewed in the installed state of the mixer, with means for fluid drop distribution of the portions of the fluid spray dispersal.

Therefore, the previously customary sheet metal correction plates which work against the later swirl can be omitted just like the previously customary drop stabilization.

Figure 2:
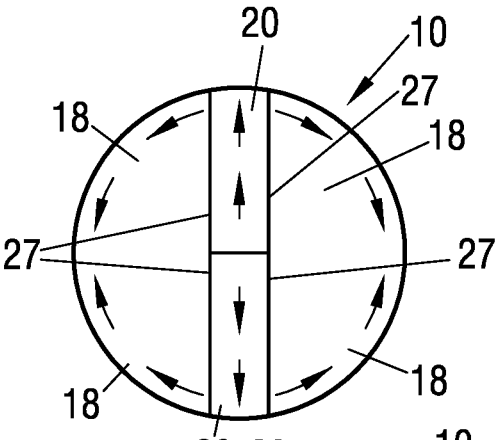
Figure 3:
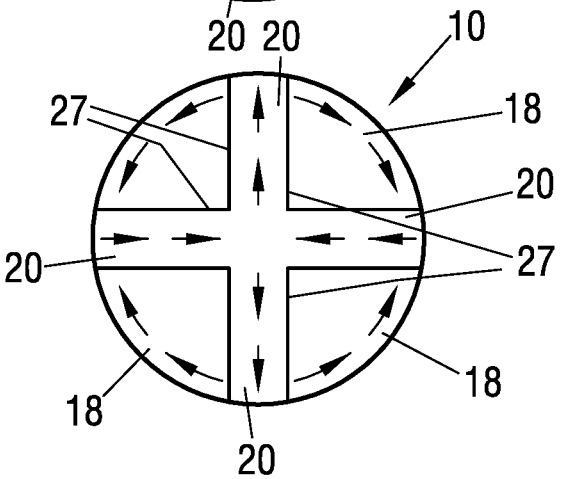
Figure 4:
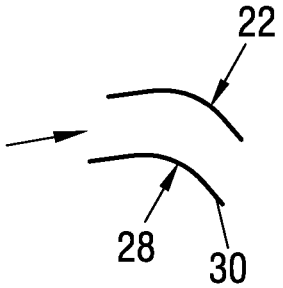
Figure 5A:
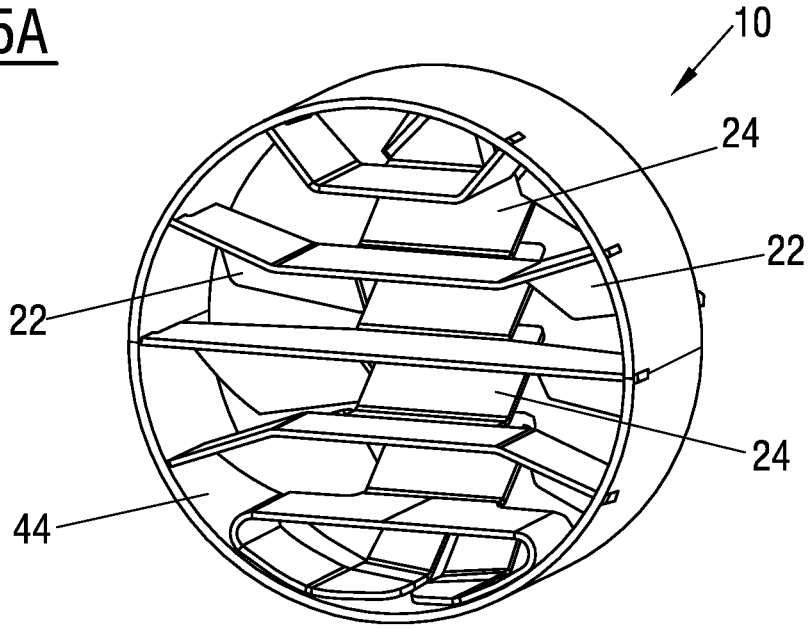
Figure 5B:
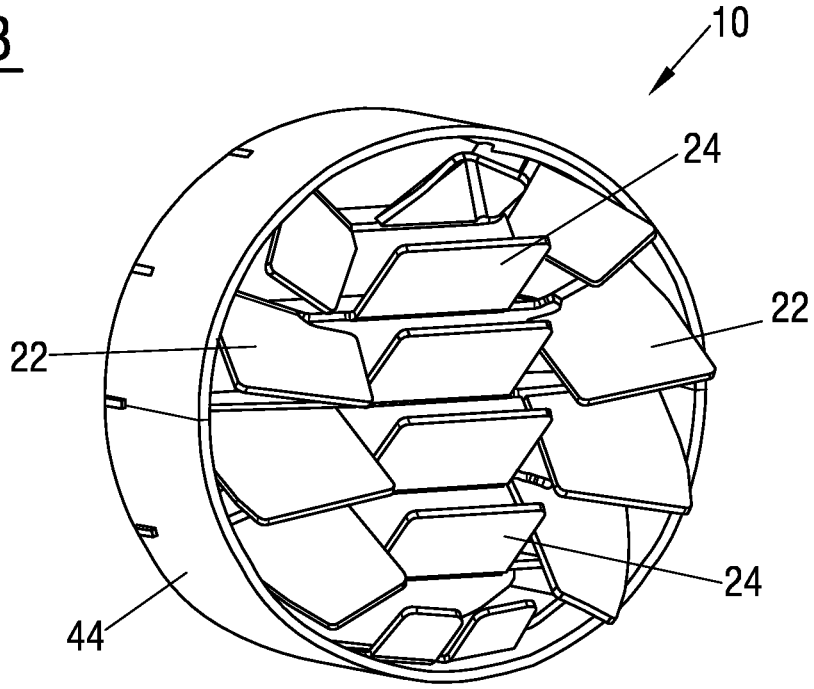
Figure 6:
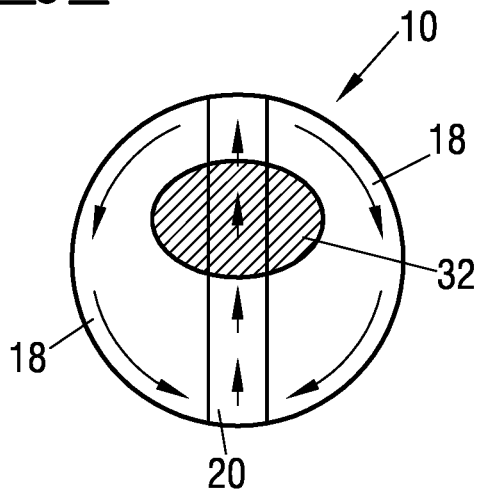
Figure 7:
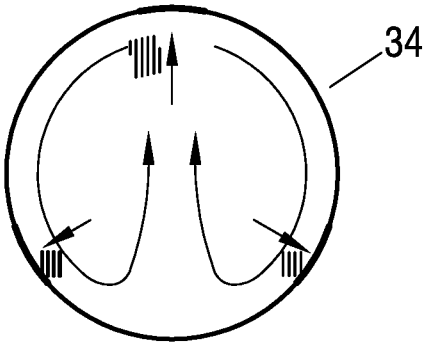
Figure 8:
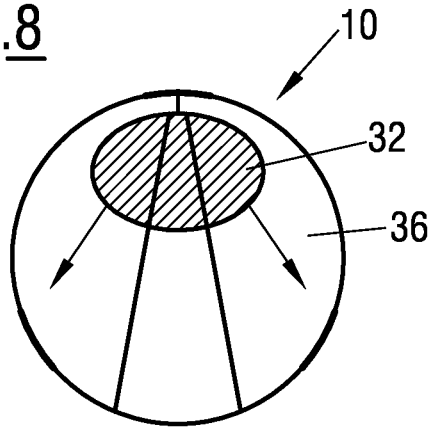
Figure 9:
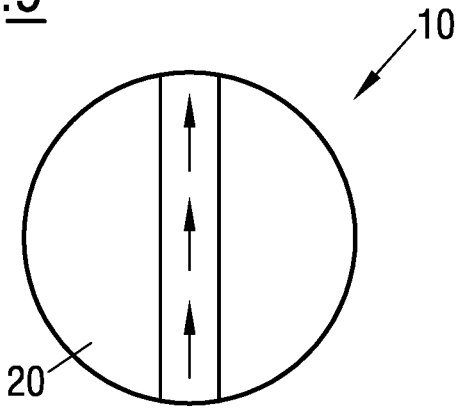
Figure 10:
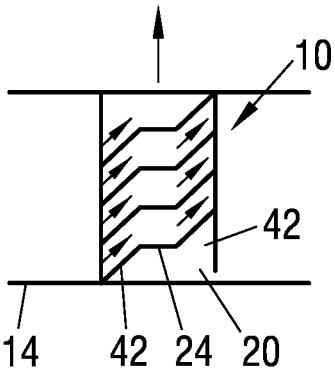
Figure 16:
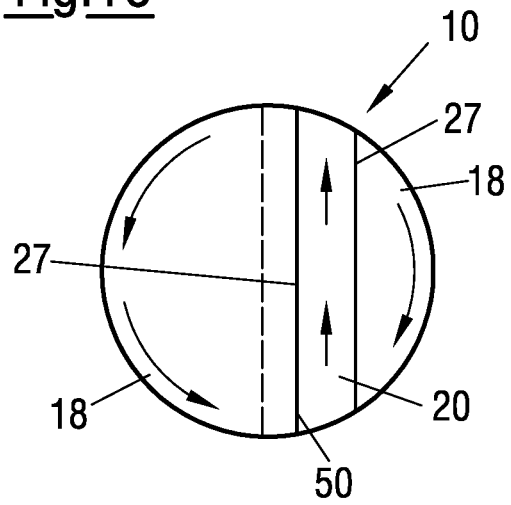
Figure 17:
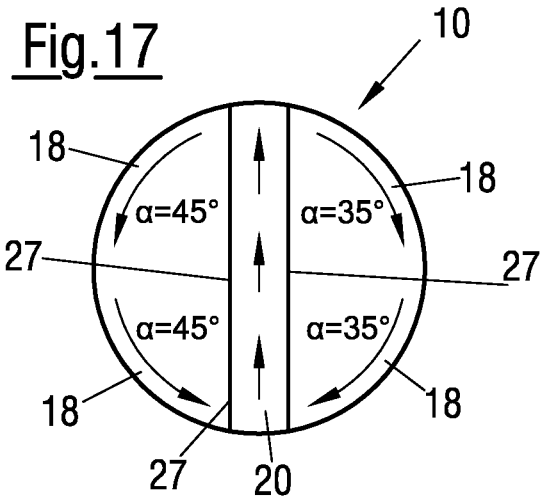
Figure 18:
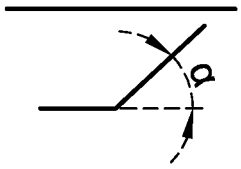
Figure 19:
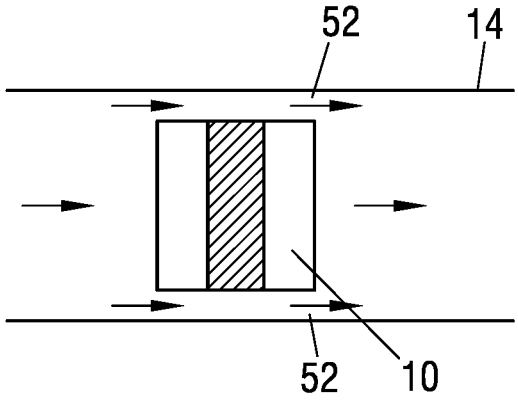
Figure 20:
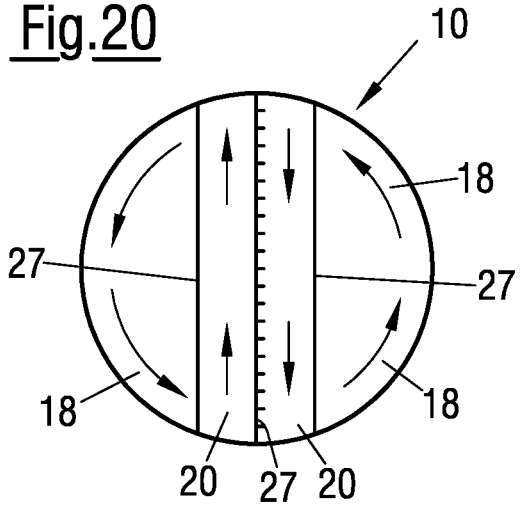
Figure 21:
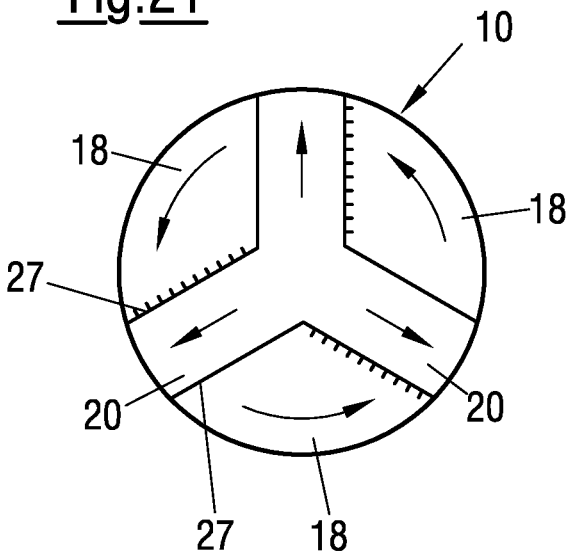
Figure 22:
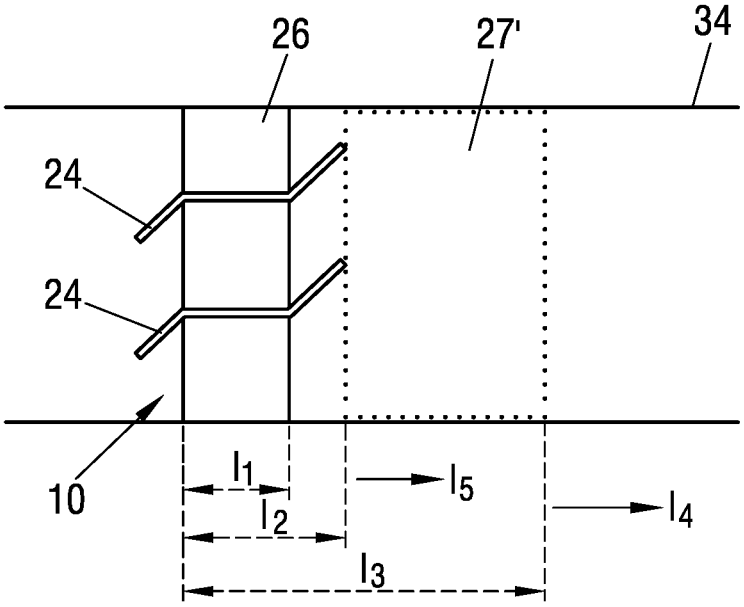
Figure 23:
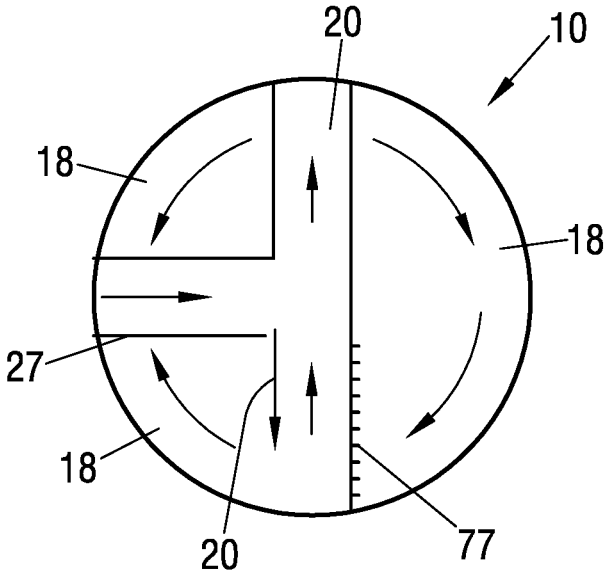
Figure 24:
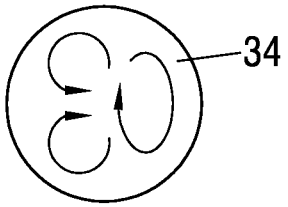
Figure 25:
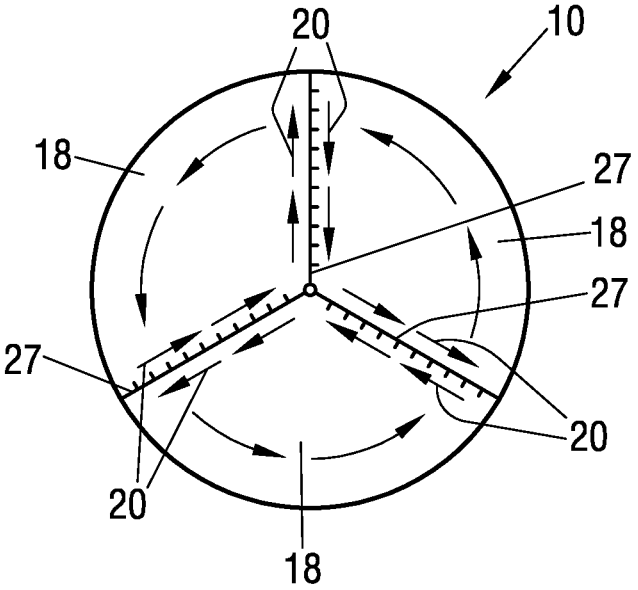
Figure 26:
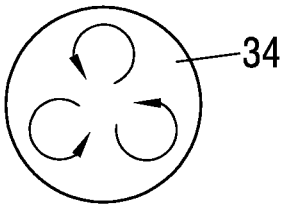
Figure 27:
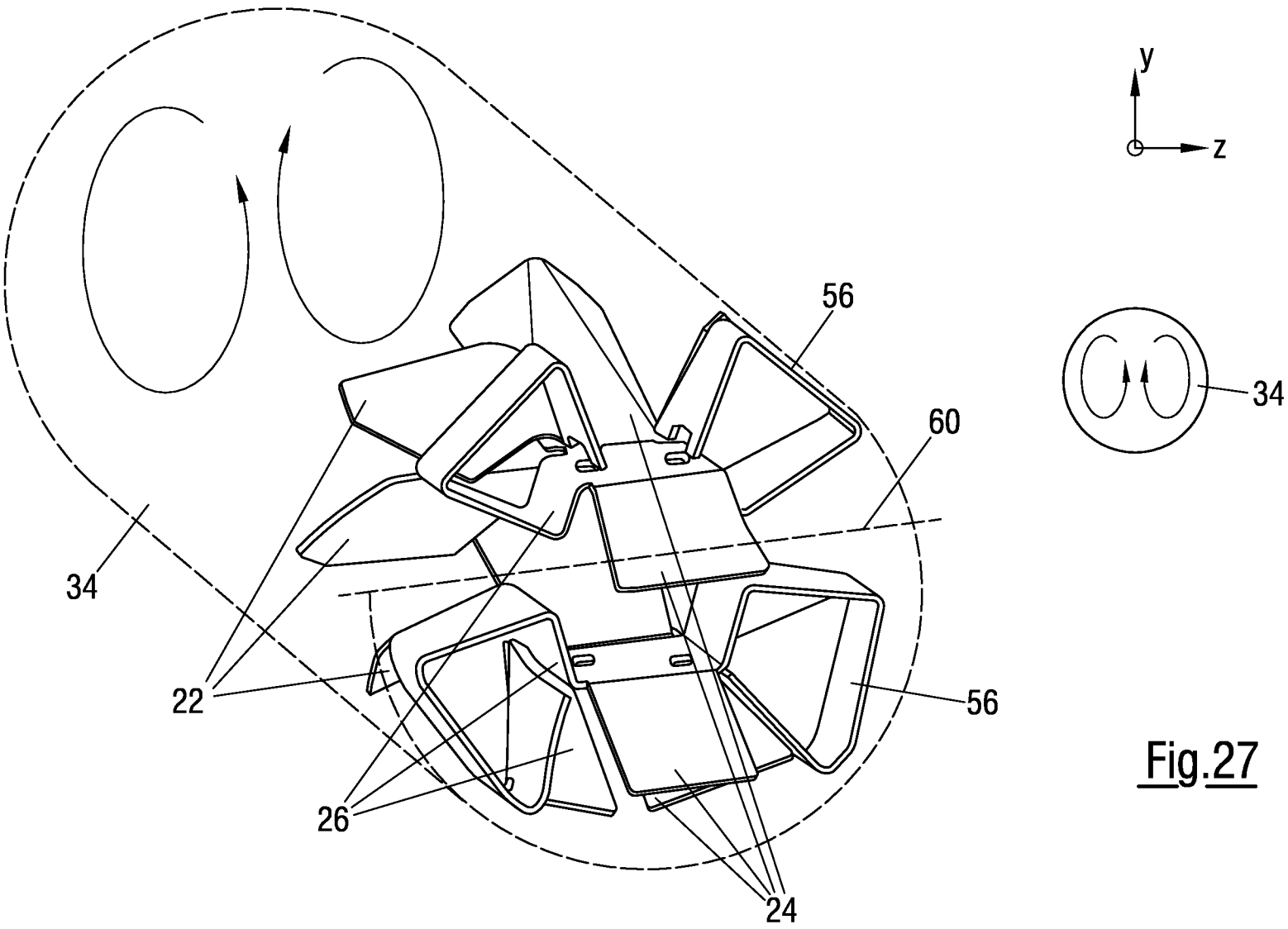
Figure 28:
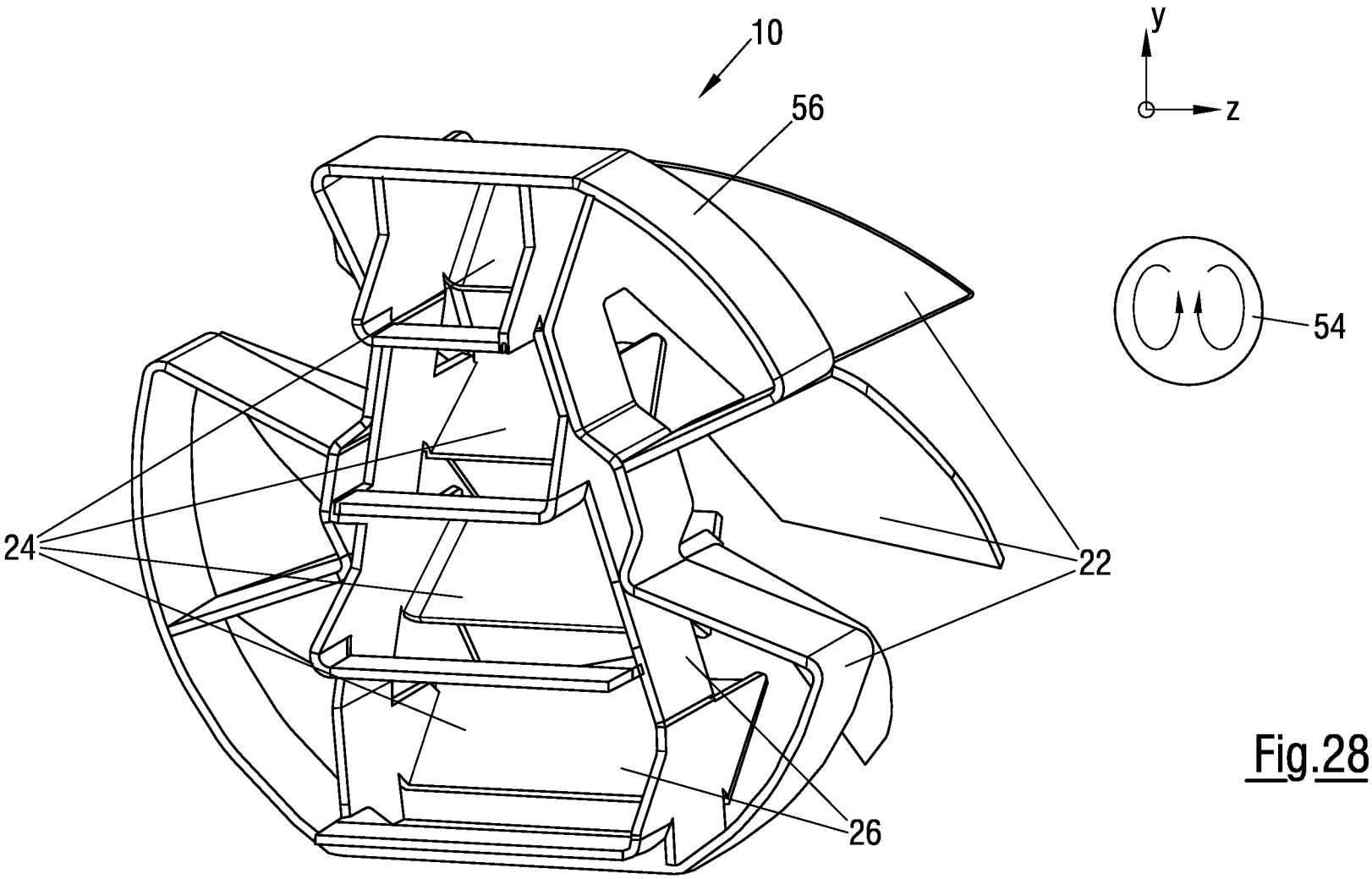
Figure 29:
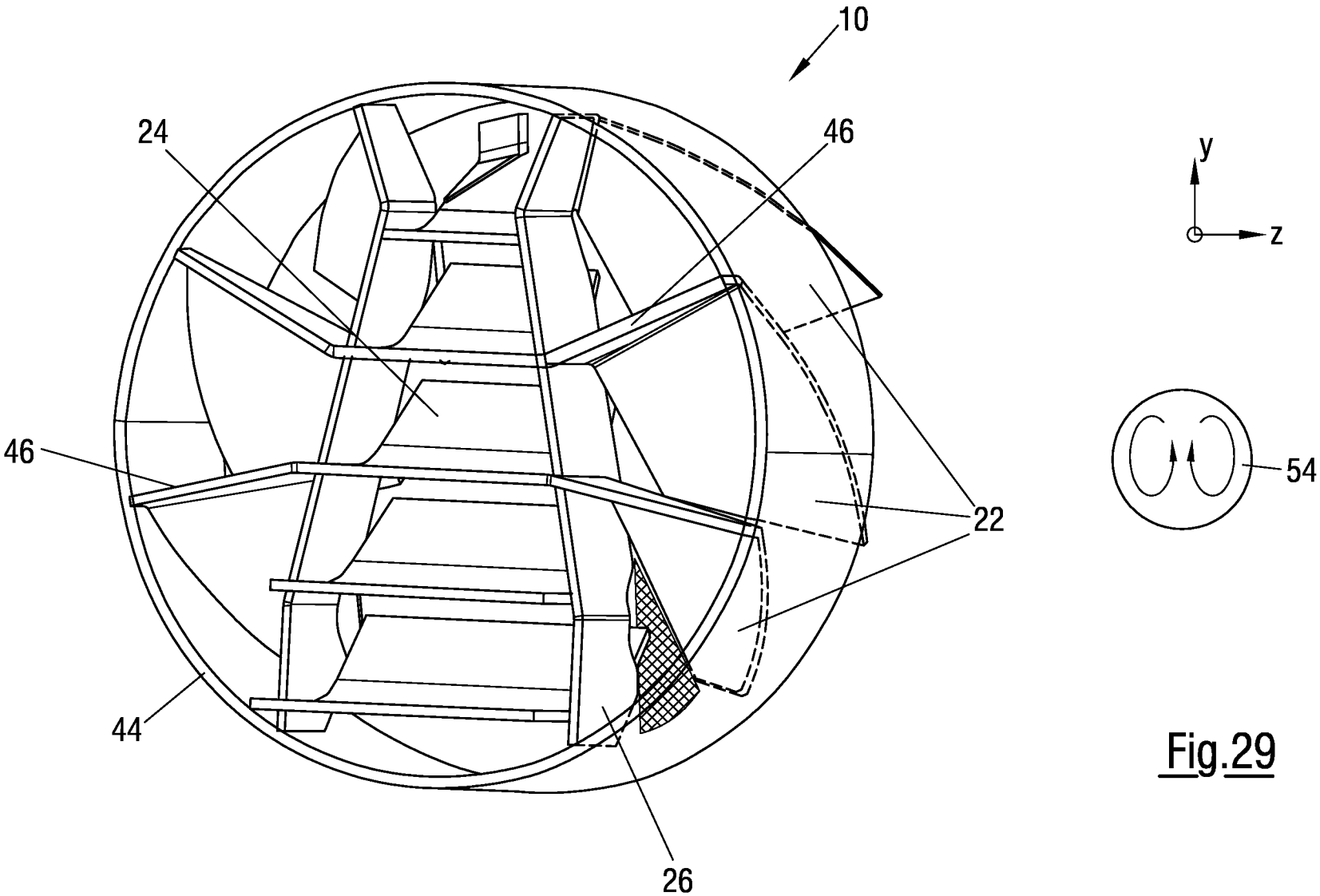
Figure 30:
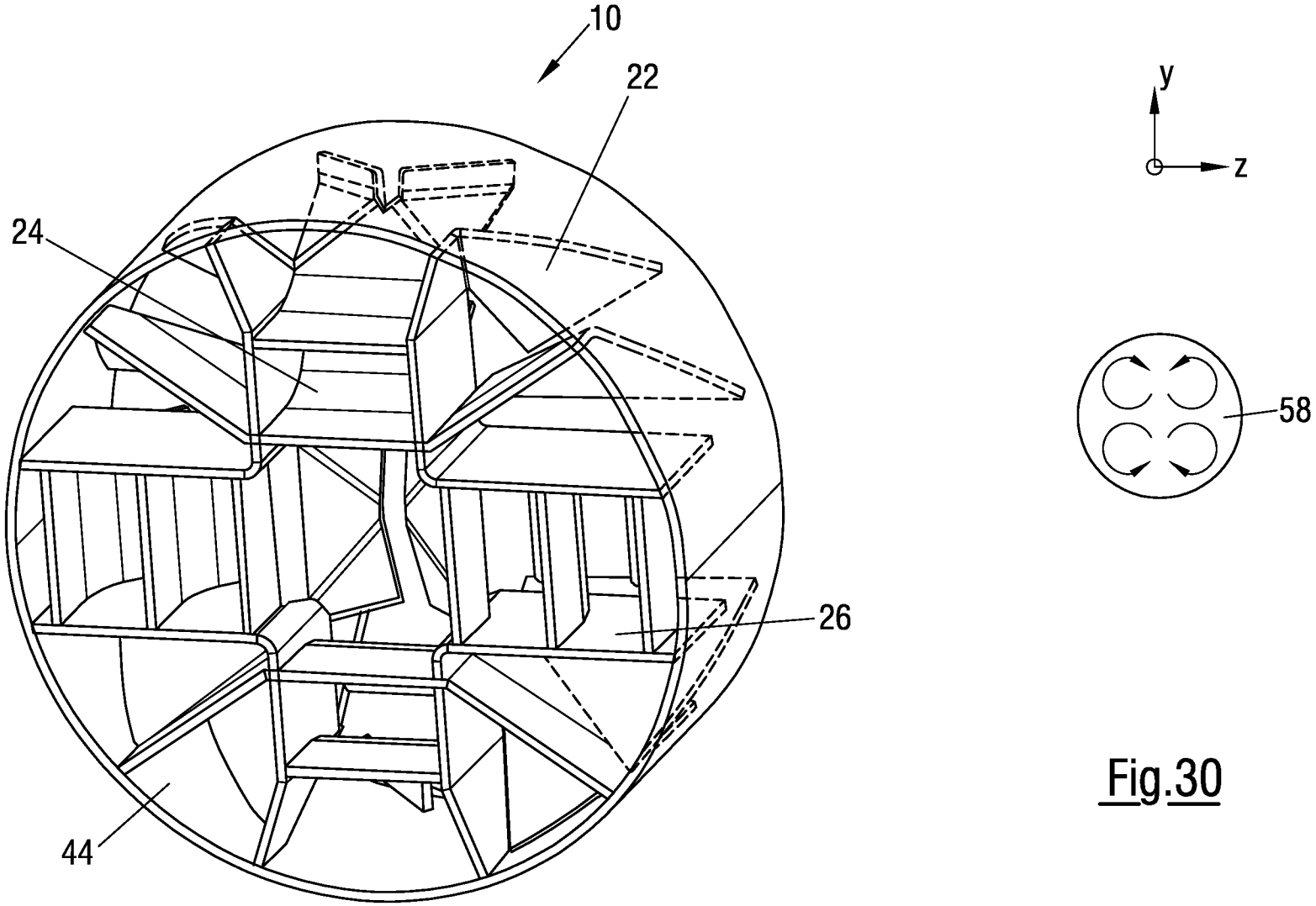
Figure 31:
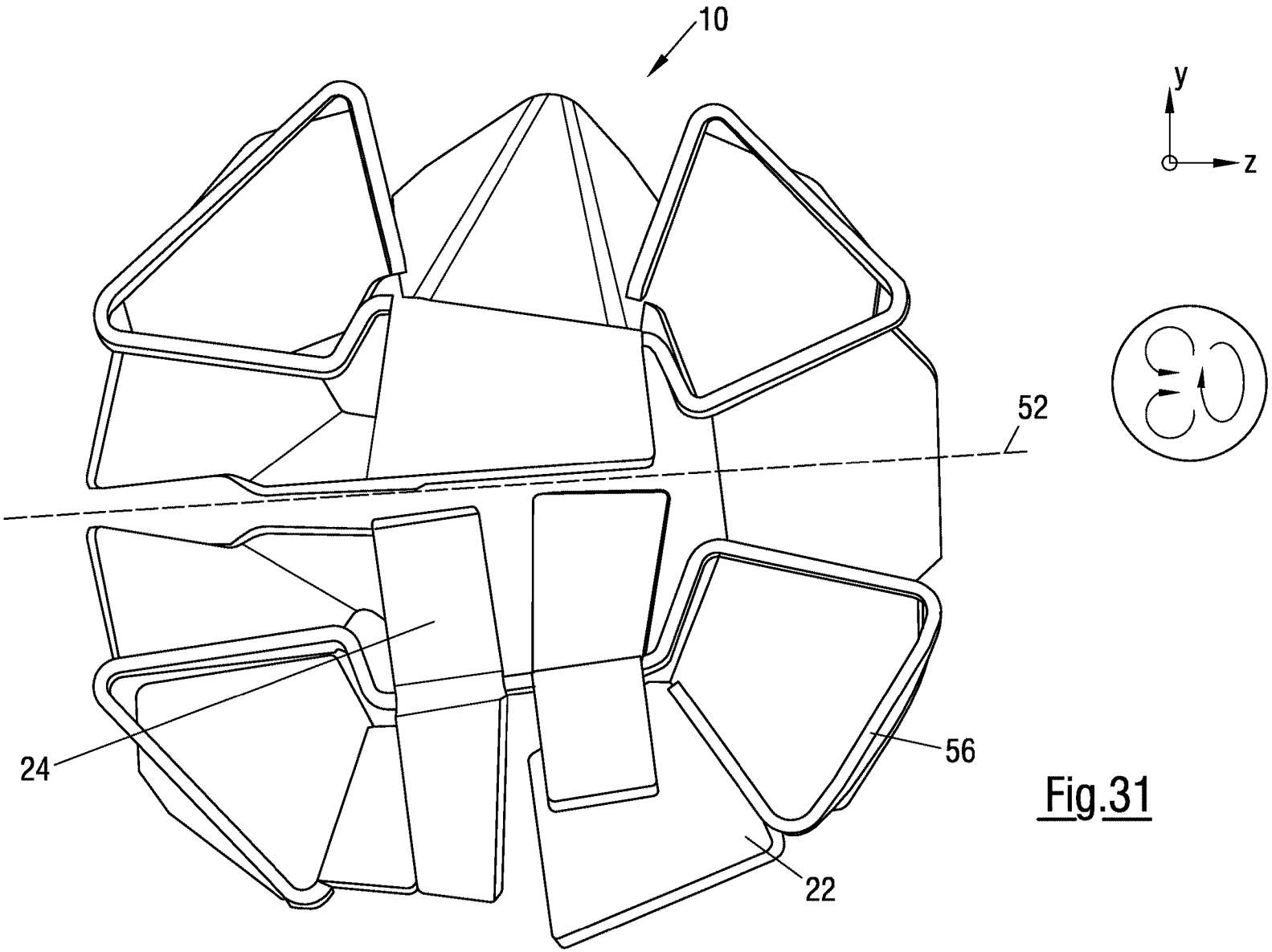
Figure 32:
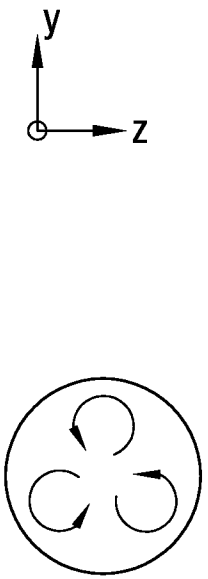
Figure 32:
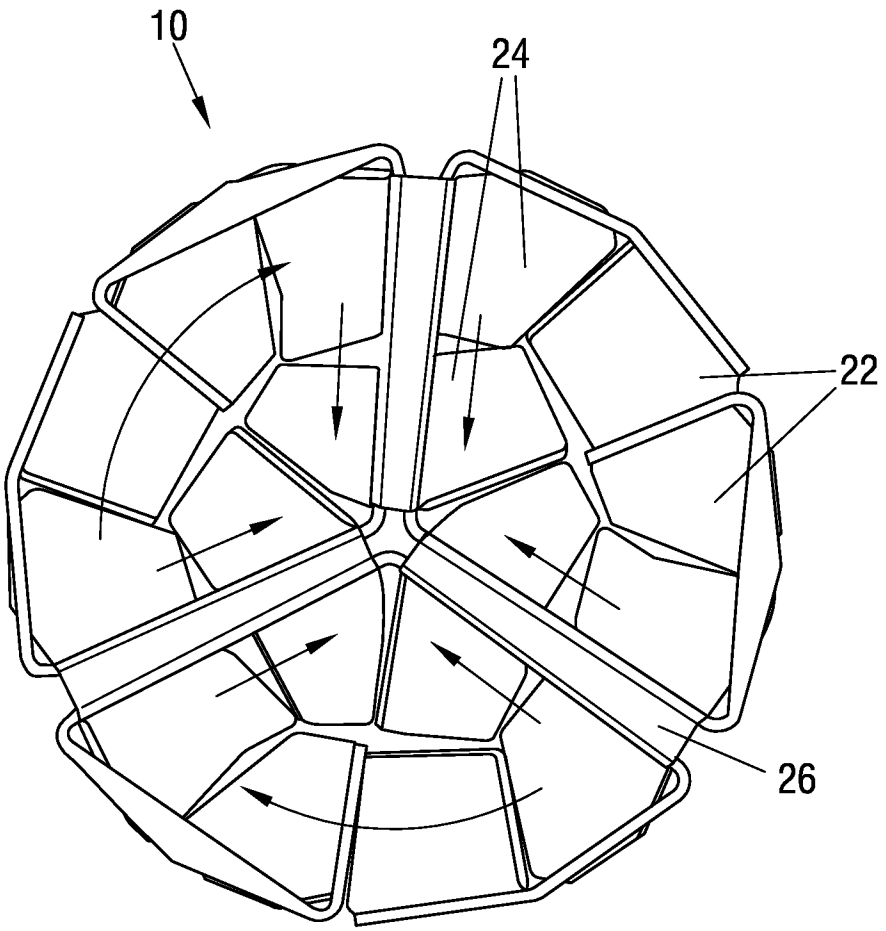

The invention will be explained in more detail in the following with reference to embodiments and to the drawing; there are shown therein:

FIG. 1 a schematic cross-sectional representation of an exemplary embodiment of the mixer in accordance with the invention with swirl regions arranged with mirror symmetry;

FIGS. 2 and 3 schematic cross-sectional representations of two exemplary embodiments of the mixer in accordance with the invention with both swirl regions arranged with mirror symmetry and radial displacement regions arranged with mirror symmetry;

FIG. 4 a schematic representation of an exemplary swirl element;

FIG. 5A an exemplary embodiment, kept particularly simple, of a mixer in accordance with the invention in an isometric view in the flow direction;

FIG. 5B the mixer in accordance with FIG. 5A in an isometric view against the flow direction;

FIG. 6 a schematic representation of a mixer which is acted on by an exemplary fluid spray cone;

FIG. 7 a schematic representation of exemplary flow conditions and fluid conditions in a mixing pipe subsequent to the mixer;

FIG. 8 a schematic cross-sectional representation of an exemplary embodiment of the mixer in accordance with the invention with a strong fluid spray dispersal and a mixer design which enables a downwardly increased fluid distribution;

FIGS. 9 and 10 a schematic cross-sectional representation and a schematic longitudinal sectional representation of an exemplary radial displacement region with radial displacement elements designed in two stages;

FIG. 11 a schematic cross-sectional representation of an exemplary divisible embodiment of the mixer in accordance with the invention in which a continuous sheet metal separation plate was omitted;

FIG. 12 a schematic cross-sectional representation of an exemplary embodiment of the mixer in accordance with the invention in which the jacket of the mixer is oval in cross-section;

FIGS. 13 to 15 schematic representations of an exemplary embodiment of a pair of mutually oppositely disposed swirl elements which form a single-piece component with a radial displacement element arranged therebetween;

FIG. 16 a schematic cross-sectional representation of an exemplary embodiment of the mixer in accordance with the invention with a radial displacement region laterally offset with respect to a central plane extending in an axial direction;

FIG. 17 a schematic cross-sectional representation of an exemplary embodiment of the mixer in accordance with the invention with swirl regions having different swirl angles;

FIG. 18 a schematic cross-sectional representation of a swirl element set at a specific swirl angle with respect to the axial exhaust gas flow;

FIG. 19 a schematic longitudinal sectional representation of an exemplary embodiment of the mixer in accordance with the invention arranged within an exhaust gas line, with the mixer having a smaller cross-section than the exhaust gas line to form a bypass which surrounds said mixer;

FIGS. 20 and 21 schematic cross-sectional representations of two exemplary embodiments of the mixer in accordance with the invention with both swirl regions arranged with point symmetry and radial displacement regions arranged with point symmetry;

FIG. 22 a schematic longitudinal sectional representation of different embodiments with separation regions of different lengths and with a separation element or sheet metal separation plate arranged downstream;

FIG. 23 a schematic cross-sectional representation of an exemplary embodiment of the mixer in accordance with the invention, in which embodiment both the swirl regions and the radial displacement regions are each arranged without symmetry;

FIG. 24 a schematic representation of the swirl resulting with the mixer in accordance with FIG. 23 in a mixing pipe subsequent to the mixer;

FIG. 25 a schematic cross-sectional representation of a further exemplary embodiment of a point-symmetrical mixer;

FIG. 26 a schematic representation of the swirl resulting with the mixer in accordance with FIG. 25 in a mixing pipe subsequent to the mixer;

FIG. 27 a perspective representation of an exemplary jacketless embodiment of a mixer in accordance with the invention in a mirror-symmetrical, divided design and with two swirl regions generating swirl in opposite directions;

FIG. 28 a perspective representation of a further exemplary jacketless embodiment of a mixer in accordance with the invention in a mirror-symmetrical design with two swirl regions generating swirl in opposite directions;

FIG. 29 a perspective representation of an exemplary embodiment of a mixer in accordance with the invention in a mirror-symmetrical design with a jacket, with two swirl regions generating swirl in opposite directions and with pairs of mutually oppositely disposed swirl elements which form a single-piece component with a respective radial displacement element arranged therebetween;

FIG. 30 a perspective representation of an exemplary embodiment of a mixer in accordance with the invention in a mirror-symmetrical design with a jacket and with four mutually separate swirl regions for generating symmetrical vortices;

FIG. 31 a perspective representation of an exemplary embodiment of a mixer in accordance with the invention in a jacketless, divided design with three mutually separate swirl regions; and FIG. 32 a perspective representation of an exemplary embodiment of a mixer in accordance with the invention in a point-symmetrical design with three mutually separate swirl regions, with the number of sheet metal carrier plates being equal to the number of swirl elements.

FIGS. 1 to 32 show different embodiments of a mixer 10 in accordance with the invention for mixing an exhaust gas flow 12 with a fluid 16 injected into an exhaust gas line 14.

In this respect, the mixer 10 in each case comprises both means for generating a swirl and means for a radial displacement in the exhaust gas flow admixed with the fluid 16 and flowing axially through the mixer 10. The swirl generation means and the radial displacement means are each arranged and designed such that, viewed over the cross-section of the mixer 10 perpendicular to the axial exhaust gas flow 12, at least two mutually separate swirl regions 18 result and at least one radial displacement region 20 results which is in each case arranged between two mutually separate swirl regions.

The tangentially acting swirl generation means can in this respect comprise a plurality of swirl elements 22 and the radial displacement means can comprise a plurality of radial displacement elements 24. At least some of the swirl elements 22 and/or at least some of the radial displacement elements 24 can respectively be supported or formed at a carrier element 26 (cf. FIGS. 13 and 15), in particular at a sheet metal carrier plate.

At least some of the swirl regions 18 can be separated from one another by separation elements 17, in particular by sheet metal separation plates. In this respect, at least some of the separation elements 27 can also be formed by carrier elements 26.

As indicated by dotted lines in FIGS. 20, 21, 23 and 25, in particular to maintain the swirl structure generated, at least some of the separation elements 27 can be axially extended beyond the swirl elements 22 and the radial displacement elements 24.

As can in particular be seen from FIGS. 1 to 3, 6, 7, 11, 12, 16, 17, 20, 21 and 23 to 25, the swirl generation means are arranged and designed such that a tangential deflection of the exhaust gas flow 12 admixed with the fluid is radially outwardly generated in a respective swirl region 18. In addition, a respective radial displacement region 20 can be arranged between adjacent swirl regions 18, viewed over the cross-section of the mixer 10 perpendicular to the axial exhaust gas flow 12.

As can, for example, be seen from FIGS. 2 and 3, the radial displacement means can, for example, be arranged and designed such that at least two separate radial displacement regions 20 result, viewed over the cross-section of the mixer 10 perpendicular to the axial exhaust gas flow 12.

The mutually separate swirl regions 18 and/or the different radial displacement regions 20 can respectively be arranged with mirror symmetry (cf. e.g. FIGS. 1 to 3, 6, 11, 12 and 17), with point symmetry (cf. e.g. FIGS. 20, 21 and 25) or also without symmetry (cf., for example, FIG. 23), viewed over the cross-section of the mixer 10 perpendicular to the axial exhaust gas flow 12.

In the mixer 10 shown in FIG. 1, a radial displacement region 20 generating a radial displacement in one direction is provided between two mutually separate swirl regions 18 generating swirl in opposite directions.

In contrast, in the embodiment in accordance with FIG. 2, the swirl generation means and the radial displacement means of the mixer 10 are arranged and designed such that four separate swirl regions 18 result, with swirl being generated in one direction by a pair of swirl regions 18 disposed diagonally opposite one another, viewed over the cross-section of the mixer 10 perpendicular to the axial exhaust gas flow 12, and with swirl being generated in the opposite direction by another pair of swirl regions 18 disposed diagonally opposite one another, viewed over the cross-section of the mixer 10 perpendicular to the axial exhaust gas flow 12. In addition, two radial displacement regions 20 result which are consecutive to one another in a radial direction, viewed over the cross-section of the mixer 10 perpendicular to the axial exhaust gas flow 12, and which are each arranged between two swirl regions 18 generating swirl in opposite directions. A radial displacement is generated in opposite directions in the two radial displacement regions 20 which are consecutive to one another in the radial direction.

Four mutually separate swirl regions 18 are also generated again in the mixer 10 shown in FIG. 3, with swirl being generated in one direction by a pair of swirl regions 18 disposed diagonally opposite one another, viewed over the cross-section of the mixer 10 perpendicular to the axial exhaust gas flow 12, and with swirl being generated in the opposite direction by another pair of swirl regions 18 disposed diagonally opposite one another, viewed over the cross-section of the mixer 10 perpendicular to the axial exhaust gas flow 12. In this respect, in the present case, a first pair of radial displacement regions 20 are provided which are consecutive to one another in a first radial direction, viewed over the cross-section of the mixer 10 perpendicular to the axial exhaust gas flow, and a further pair of radial displacement regions 20 are provided which are consecutive to one another in a further radial direction perpendicular to the first radial direction, viewed over the cross-section of the mixer 10 perpendicular to the axial exhaust gas flow 12. In this respect, a radial displacement is generated in opposite directions in the two radial displacement regions 20, which are consecutive to one another in a respective radial direction, of a respective pair of radial displacement regions 20. In addition, a respective radial displacement region 20 of the two pairs of radial displacement regions 20 is arranged between two swirl regions 18 generating swirl in opposite directions.

In FIGS. 1 to 3, the mixer 10 is shown in the respective alignment which it adopts in the installed state. For example, in the embodiment in accordance with FIG. 2, a displacement takes place radially upwardly through the radial displacement region 20 shown at the top when the mixer 10 is installed and a displacement takes place radially downwardly through the radial displacement region 20 shown at the bottom when the mixer 10 is installed, whereas swirl is generated in opposite directions in the upper and lower halves of the mixer 10, in each case at the right and at the left of the respective radial displacement region 20.

The swirl elements 22 can each comprise a base body 28 having at least one curved swirl generation section 30 serving for the swirl generation (cf. FIG. 4).

FIG. 5A shows a particularly simple embodiment of the mixer 10 in accordance with the invention in an isometric view in the flow direction. In FIG. 5B, this mixer 10 in accordance with FIG. 5A is again shown in an isometric view against the flow direction. This embodiment of the mixer 10 in accordance with the invention has sufficient stability which makes it possible to omit the sheet metal carrier plates 26 serving for the component stabilization.

FIG. 6 shows an exemplary mixer 10 which is acted on by a fluid spray cone 32. In this respect, in the present case, two swirl regions 18 generating swirl in opposite directions are again provided analogously to the mixer in accordance with FIG. 1 and a radial displacement region 20 is provided which is arranged therebetween and which generates a radial displacement in one direction. As can be seen from FIG. 6, the fluid spray cone 32 comprises all three regions 18, 20.

FIG. 7 shows exemplary flow conditions and drop conditions in a schematic representation in a mixing pipe 34 subsequent to, for example, a mixer 10 in accordance with FIG. 6. The regions marked in bold show the distributed fluid in the trail of the mixer. The distribution predominantly occurs at temperatures which, due to the Leiden frost effect, pass on the drops through the mixer instead of evaporating them in the mixing region.

As can, for example, be seen from FIGS. 1 to 3, 6, 8, 12, 16, 17, 20, 21 and 23, at least two adjacent swirl regions 18 can be separated from one another by two carrier elements 26 between which a radial displacement region 20 is formed. In this respect, for example in the embodiments shown in FIGS. 1 to 3, 6, 12, 16, 17, 20, 21 and 23, the two carrier elements 26 are aligned in parallel with one another to bound a radial displacement region 20 disposed therebetween which has a radially continuously unchanging width. The carrier elements 26 serve for a stiffening of the mixer and do not contribute to the mixing or the drop formation.

In contrast, FIG. 8 shows an exemplary alternative embodiment in which the two separation elements 27 are arranged at a corresponding angle relative to one another to bound a radial displacement region 20 disposed therebetween which continuously becomes wider radially downwardly. In the present case, the mixer is again divided into two swirl regions 18 and one radial displacement region 20, wherein the radial displacement region 20 is narrower at the top and wider at the bottom such that a radial displacement region 20 results which is at least substantially triangular in cross-section and a ratio of the fluid phase arising in the radial displacement region and in the tangential swirl generation region results that is as ideal as possible. In general, however, any other division of these regions is also possible.

In addition, in this construction shown in FIG. 8, a reinforcement of the portions of the fluid spray distribution 36 is achieved downwardly, viewed in the installed state of the mixer 10, whereby a correspondingly improved fluid drop distribution in particular results. This reinforced fluid spray distribution 36 with downwardly increased fluid portions is schematically indicated by arrows in FIG. 8 and already provides an improved fluid distribution just subsequent to the mixer 10.

FIGS. 9 and 10 show an exemplary radial displacement region 20 with radial displacement elements 24 designed in two stages in a schematic cross-sectional representation and a schematic longitudinal sectional representation. In this respect, the base body of a respective two-stage radial displacement element 24 is provided with two respective radial displacement sections 42 which each continuously generate a radial displacement, viewed in the direction of the axial exhaust gas flow 12, and between which an intermediate section without radial displacement is provided.

In the embodiment shown in FIG. 11, the mixer 10 is designed in two parts, wherein it can be divided or is divided along a horizontal central plane X in that, as indicated by chain dotting, continuous carrier elements or sheet metal carrier plates 26 were omitted or are interrupted. The respective division is in this respect coordinated with the swirl regions 18 and radial displacement regions 20 provided. A welding of the mixer at the inside is not necessary.

The mixer 10 can be jacketless or can also be provided with a jacket 44.

FIG. 12 shows an exemplary embodiment of a mixer 10 in accordance with the invention in which the jacket 44 of the mixer 10 is oval in cross-section. In general, the jacket 44 of the mixer 10 can also be circular or similar, however.

If the mixer 10 is provided with a jacket 44, it can also at least partly be produced by swirl elements 22.

As can be seen from FIGS. 13 to 15, such embodiments of the mixer 10 are also conceivable in which at least one pair of mutually oppositely disposed swirl elements 22 form a single-piece component 46 or a single-piece and stretched component 46 with a radial displacement element 24 arranged therebetween. In this respect, a respective single-piece or stretched component 46 comprising a pair of swirl elements 22 and a radial displacement element 24 arranged therebetween is at least partly supported at two adjacent carrier elements or sheet metal carrier plates 26 by which the respective swirl regions 18 and the respective radial displacement region 20 are simultaneously separated from one another. As shown, a respective single-piece component 46 comprising a pair of swirl elements 22 and a radial displacement element 24 arranged therebetween can at least partly be supported at the two adjacent carrier elements or sheet metal carrier plates 26 by sectionally engaging into slits 48 provided in the carrier elements or sheet metal carrier plates 26. As can in particular be seen from FIGS. 13 and 14, the swirl elements 22 can each comprise a section in particular curved in a vane-like manner.

The components 46 can, for example, only be connected at the outside and can, for example, be welded to the mixing pipe. At the inside, welding can either be completely omitted or a fixing can take place using relatively few welding points.

In a correspondingly rigid construction, carrier elements can be omitted as is shown in FIG. 33.

In the further exemplary embodiment shown in FIG. 16, the mixer 10 comprises a radial displacement region 20 which is laterally offset with respect to a central plane 50 extending in an axial direction and which contributes to an increase in the mixing on an asymmetrical inflow of the gas phase or on an asymmetrical action on the fluid phase.

The mixing and the distribution can, for example, be increased further in that, as shown in FIG. 17, the mixer 10 is provided with swirl regions 18 having different swirl angles. In this respect, in the present case, two mutually separate regions are, for example, generated of which one has two swirl regions 18, each having a swirl angle of, for example, 35°, at one side of a radial displacement region 20 and one has two swirl regions 18, each having a swirl angle of, for example, 45°, at the oppositely disposed side of the radial displacement region 20. The generation of an asymmetrical fluid spray cone or an asymmetrical inflow is also possibly conceivable again in this case. In addition, the dominance of a respective swirl with respect to a further swirl, which could otherwise be resolved, is prevented by this embodiment. These measures may also be necessary in asymmetrical conditions.

FIG. 18 shows in a schematic cross-sectional representation a swirl element 22 set at a specific swirl angle $\alpha$ with respect to the axial exhaust gas flow 12.

FIG. 19 shows in a schematic longitudinal sectional representation an exemplary embodiment of a mixer 10 in accordance with the invention arranged within the exhaust gas line 14, with the mixer 10 having a smaller cross-section than the exhaust gas line 14 to form a bypass 52 which surrounds said mixer 10 in a ring shape. A reduced pressure loss thus results via the mixer 10.

FIGS. 20 and 21 show in schematic cross-sectional representations two exemplary embodiments of the mixer 10 in accordance with the invention with both swirl regions 18 arranged with point symmetry and radial displacement regions 20 arranged with point symmetry. In this respect, in the embodiment in accordance with FIG. 20, two mutually parallel radial displacement regions 20 are provided which generate a radial displacement in opposite directions, whereas, in the embodiment in accordance with FIG. 21, three radial displacement regions 20 are provided which are, for example, arranged in the form of a star and in which a respective displacement of the exhaust gas takes place radially outwardly. In both embodiments shown in these FIGS. 20 and 21, swirl is generated in the same direction in each case in the different swirl regions 18.

As is indicated by chain dotting in FIGS. 20 and 21, to maintain the swirl structure generated, at least some of the separation elements or sheet metal separation plates 27 can be axially extended beyond the swirl elements 22 and the radial displacement elements 24. In this respect, the swirl structure generated is maintained longer in the exhaust gas line by these extended separation elements or sheet metal separation plates 27 indicated by dots. Due to the extended separation elements 27 indicated by dots, the smaller micro-swirl regions only later combine to form a macro-swirl, viewed in the flow direction of the exhaust gas.

In the representation in accordance with FIG. 22, three versions are shown by way of example with carrier regions or carrier elements 26 which have different lengths, viewed in the flow direction of the exhaust gas. In this respect, the carrier region length $I_1$ of the first version corresponds to that of the embodiment shown in FIG. 27. The somewhat longer carrier region length of the second version designated by $I_2$ with correspondingly extended sheet metal plates corresponds to the carrier region length provided in the mixers 10 in accordance with FIGS. 28 and 29. In accordance with the third version shown in FIG. 22, to maintain the swirl structure generated, the mixer 10 comprises at least one separation element 27' arranged downstream which is separate from the multi-swirl region and from the at least one radial displacement region. With such a separation element 27' arranged downstream, the effective separation region is extended to a length $I_3$ which clearly extends beyond the last-mentioned separation region length $I_2$. In the latter case, due to the separation element 27' arranged downstream, the starting point $I_4$ from which the microstructure of the multi-swirl, such as of a triple swirl generated in the mixer 10 in accordance with FIG. 21, starts to combine or to disintegrate and to transform into a mono-swirl, for example, correspondingly lies further back than the respective starting point $I_5$ which results with the separation region length $I_2$.

As shown in FIG. 23, the mixer 10 can, for example, also be designed such that both the swirl regions 18 generated and the radial displacement regions 20 generated are each arranged without symmetry. As indicated by dots, at least one extended separation element or sheet metal separation plate 27 can also again be provided in this case in order to maintain the micro-vortices for longer or to postpone the starting point from which the microstructure of the multi-swirl starts to combine or to disintegrate and to transform into a mono-swirl, for example.

FIG. 24 shows in a schematic representation the swirl resulting with the mixer in accordance with FIG. 23 in a mixing pipe 34 or in the exhaust gas line subsequent to the mixer 10.

FIG. 25 shows an exemplary embodiment of a point-symmetrical mixer 10 with extended separation elements or sheet metal separation plates 27, which are also again indicated by dots here, in which embodiment the mutually adjacent swirl regions 18 are separated from one another by only one separation element or sheet metal separation plate 27 in each case. In this respect, the separation elements 27 in the present case are arranged in the form of a star to form three swirl regions 18 in which swirl is generated counter-clockwise in each case, wherein a radial displacement in the opposite direction results at both sides of a respective separation element 27. As before, it is again achieved by the extended separation elements 27 indicated by dots that the micro-vortices are maintained longer.

In FIG. 26, the swirl resulting with the mixer 10 in accordance with FIG. 25 in a mixing pipe 34 subsequent to the mixer 10 or in the exhaust gas line is shown schematically.

FIG. 27 shows an exemplary jacketless embodiment of a mixer 10 in accordance with the invention in a mirror-symmetrical, divided design for the generation of two swirl regions generating swirl in opposite directions. In this respect, the separation plane 60 and the double swirl 54 resulting in the adjoining exhaust gas pipe or mixing pipe 34 can also be seen in addition to the respective swirl elements 22 and radial displacement elements 24. Moreover, the respective carrier elements or sheet metal carrier plates 26 and connection points 56 for connecting the mixer 10 to the exhaust gas pipe 34 are shown. In the present case, the mixer 10 is designed in two parts in that it can be assembled or is assembled from two sheet metal parts which are correspondingly folded over or folded to form the swirl elements 22, the radial displacement elements 24 and the carrier elements 26. Accordingly, it is a mixer 10 of a relatively simple design.

The alignment of the mixer 10 in FIG. 27, just like that of the mixers 10 shown in the subsequent FIGS. 28 to 32, in each case corresponds to the alignment of said mixer in the installed state such that the upper and lower regions in the representation in accordance with FIG. 27, for example, correspond to the upper and lower regions of the installed mixer 10.

A further exemplary jacketless embodiment of the mixer 10 in accordance with the invention is shown in a mirror-symmetrical design in a perspective representation in FIG. 28 with two swirl regions generating swirl in opposite directions. In this respect, the respective swirl elements 22, radial displacement elements 24, carrier elements or sheet metal carrier plates 26 and connection points 56 for connecting the mixer 10 to the mixing pipe or exhaust gas pipe 34 can also be seen again in this representation in accordance with FIG. 28. In addition to the mixer 10, the resulting double swirl 54 is also shown again in the present case.

FIG. 29 shows in a perspective representation a further exemplary embodiment of the mixer 10 in accordance with the invention in a mirror-symmetrical design with a jacket 44, two swirl regions generating swirl in opposite directions and pairs of mutually oppositely disposed swirl elements 22 which form a single-piece or stretched component 46 with a respective radial displacement element 24 arranged therebetween. In addition to the mixer 10, the resulting opposite double swirl 54 is also shown again in the present case.

In the embodiment in accordance with FIG. 30, the mixer 10 is again designed with mirror symmetry as well as with a jacket 44 and four mutually separate swirl regions for generating symmetrical vortices 58 as are schematically shown in addition to the mixer 10. In this respect, the respective swirl elements 22, radial displacement elements 24 and carrier elements or sheet metal carrier plates 26 are in particular also shown again in the representation in accordance with FIG. 30.

In the further embodiment perspectively shown in FIG. 31, the mixer 10 is jacketless, divided or divisible and designed with three mutually separate swirl regions. The swirl resulting in this respect is again shown schematically in addition to the mixer 10. In the representation in accordance with FIG. 31, the connection points 56 for connecting the mixer 10 to the exhaust gas pipe or mixing pipe 14 or 34 can in particular also be seen again in addition to the respective swirl elements 22 and radial displacement elements 24.

FIG. 32 shows in a perspective representation an exemplary embodiment of the mixer 10 in accordance with the invention in a point-symmetrical design with three mutually separate swirl regions, wherein the number of carrier elements or sheet metal carrier plates 26 can in particular be equal to the number of swirl elements 22. In this representation in accordance with FIG. 32, the respective radial displacement elements 24 and carrier elements or sheet metal carrier plates 26 can in particular also be seen again in addition to the swirl elements 22.

LIST OF REFERENCE NUMERALS

10 mixer
12 exhaust gas flow
14 exhaust gas line
16 fluid
18 swirl region
20 radial displacement region
22 swirl element
24 radial displacement element
26 carrier element or sheet metal carrier plate
27 separation element or sheet metal separation plate
27' separation element or sheet metal separation plate arranged downstream
28 base body
30 swirl generation section
32 fluid spray cone
34 mixing pipe
36 fluid spray distribution
38 base body
42 radial displacement section
44 jacket
46 single-piece or stretched component
48 slit
50 central plane
52 bypass
54 double swirl
56 connection point
58 symmetrical vortices
60 separation plane
X horizontal plane
$\alpha$ a swirl angle, setting angle

The invention claimed is:

1. A mixer for mixing an exhaust gas flow with a fluid injected into an exhaust gas line, said mixer comprising means for generating a swirl effecting a rotating flow and means for a radial displacement in the exhaust gas flow admixed with the fluid and flowing axially through the mixer, wherein the swirl generation means and the radial displacement means are arranged and designed such that, viewed over the cross-section of the mixer perpendicular to the axial exhaust gas flow, at least two mutually separate swirl regions result which are built up via tangentially acting swirl elements having the shape of a vane and at least one radial displacement region results which is arranged between two respective mutually separate swirl regions;

wherein at least some of the swirl regions are separated from one another by separation elements which are sheet metal plates;

wherein the means for radial displacement comprises radial displacement elements which are supported on a sheet metal carrier plate;

wherein at least some of the separation elements are axially extended beyond the swirl elements and the radial displacement elements, and which maintain a structure of the swirl generated by the swirl elements.

2. The mixer in accordance with claim 1, wherein the swirl generation means comprise a plurality of predominantly tangentially acting swirl elements having the shape of a vane and/or the radial displacement means comprise a plurality of radial displacement elements.

3. The mixer in accordance with claim 1, wherein at least some of the swirl elements and/or at least some of the radial displacement elements are respectively supported or formed at a carrier element.

4. The mixer in accordance with claim 3, wherein at least some of the swirl regions are separated from one another by separation elements and wherein at least some of the separation elements are formed by the carrier elements.

5. The mixer in accordance with claim 1, wherein a respective radial displacement region is arranged between adjacent swirl regions, viewed over the cross-section of the mixer perpendicular to the axial exhaust gas flow.

6. The mixer in accordance with claim 1, wherein the radial displacement means are arranged and designed such that at least two separate radial displacement regions result, viewed over the cross-section of the mixer perpendicular to the axial exhaust gas flow.

7. The mixer in accordance with claim 1, wherein the mutually separate swirl regions and/or the separate radial displacement regions are respectively arranged with mirror symmetry or with point symmetry or without symmetry, viewed over the cross-section of the mixer perpendicular to the axial exhaust gas flow.

8. The mixer in accordance with claim 1, wherein at least two mutually separate swirl regions are provided in which swirl is generated in opposite directions; and/or wherein at least two mutually separate swirl regions are provided in which swirl is generated in opposite directions and wherein at least one radial displacement region is provided between the two mutually separate swirl regions generating swirl in opposite directions.

9. The mixer in accordance with claim 1, wherein at least two mutually separate swirl regions are provided which generate swirl in opposite directions and between which a radial displacement region is arranged which generates a radial displacement in one direction; and/or wherein at least two mutually separate swirl regions are provided which generate swirl in opposite directions and between which two radial displacement regions are arranged which generate a radial displacement in opposite directions.

10. The mixer in accordance with claim 1, wherein four separate swirl regions are provided, with swirl being generated in one direction by a pair of swirl regions disposed diagonally opposite one another, viewed over the cross-section of the mixer perpendicular to the axial exhaust gas flow, and with swirl being generated in the opposite direction by another pair of swirl regions disposed diagonally opposite one another, viewed over the cross-section of the mixer perpendicular to the axial exhaust gas flow.

11. The mixer in accordance with claim 10, wherein two radial displacement regions are provided which are consecutive to one another in a radial direction, viewed over the cross-section of the mixer perpendicular to the axial exhaust gas flow, and which are each arranged between two swirl regions generating swirl in opposite directions.

12. The mixer in accordance with claim 11, wherein a radial displacement is generated in opposite directions in the two radial displacement regions consecutive to one another in the radial direction.

13. The mixer in accordance with claim 10, wherein a first pair of radial displacement regions are provided which are consecutive to one another in a first radial direction, viewed over the cross-section of the mixer perpendicular to the axial exhaust gas flow, and a further pair of radial displacement regions are provided which are consecutive to one another in a further radial direction perpendicular to the first radial direction, viewed over the cross-section of the mixer perpendicular to the axial exhaust gas flow.

14. The mixer in accordance with claim 13, wherein a radial displacement is generated in opposite directions in the two radial displacement regions, which are consecutive to one another in a respective radial direction, of a respective pair of radial displacement regions; and/or wherein a respective radial displacement region of the two pairs of radial displacement regions is arranged between two swirl regions generating swirl in opposite directions.

15. The mixer in accordance with claim 1, wherein at least some of the swirl elements are formed by a sheet metal swirl plate or by a sheet metal tangential plate and/or at least some of the radial displacement elements are formed by a sheet metal radial plate.

16. The mixer in accordance with claim 1, wherein the radial displacement elements each comprise a base body having at least one radial displacement section serving for the radial displacement; and/or wherein the radial displacement elements each comprise a base body having at least one radial displacement section serving for the radial displacement and wherein the base body of at least some of the radial displacement elements is provided with only one respective radial displacement section which continuously generates a radial displacement, viewed in the direction of the axial exhaust gas flow; and/or wherein the radial displacement elements each comprise a base body having at least one radial displacement section serving for the radial displacement and wherein the base body of at least some of the radial displacement elements is provided with at least two respective radial displacement sections which each continuously generate a radial displacement, viewed in the direction of the axial exhaust gas flow, and an intermediate section without radial displacement is provided between a respective preceding radial displacement section and a respective subsequent radial displacement section.

17. The mixer in accordance with claim 1, wherein the mixer is jacketless.

18. The mixer in accordance with claim 1, wherein the mixer is provided with a jacket.

19. The mixer in accordance with claim 18, wherein the jacket is at least partly produced by swirl elements; and/or wherein the jacket is at least circular or oval in cross-section.

20. The mixer in accordance with claim 1, wherein at least one pair of mutually oppositely disposed swirl elements is provided which forms a single-piece component with at least one radial displacement element arranged therebetween.

21. The mixer in accordance with claim 20, wherein a respective single-piece component comprising a pair of swirl elements and at least one radial displacement element arranged therebetween is at least partly supported at two adjacent carrier elements or sheet metal carrier plates by which the respective swirl regions and the respective at least one radial displacement region are separated from one another; and/or wherein a respective single-piece component comprising a pair of swirl elements and at least one radial displacement element arranged therebetween is at least partly supported at two adjacent carrier elements or sheet metal carrier plates by which the respective swirl regions and the respective at least one radial displacement region are separated from one another and wherein a respective single-piece component comprising a pair of swirl elements and at least one radial displacement element arranged therebetween is at least partly supported at the two adjacent carrier elements or sheet metal carrier plates by at least sectionally engaging into slits provided in the carrier elements or sheet metal carrier plates.

22. The mixer in accordance with claim 1, wherein the radial displacement means are arranged and designed such that at least one radial displacement region results, viewed over the cross-section of the mixer perpendicular to the axial exhaust gas flow, which is laterally offset with respect to a central plane extending in an axial direction; and/or wherein the swirl elements are arranged and designed such that swirl regions having different swirl angles result.

23. The mixer in accordance with claim 1, wherein at least two adjacent swirl regions are separated from one another by two separation elements between which a radial displacement region is formed.

24. The mixer in accordance with claim 23, wherein the two separation elements are aligned in parallel with one another to bound a radial displacement region disposed therebetween which has a radially continuously unchanging width; and/or wherein the two separation elements are arranged at a corresponding angle relative to one another to bound a radial displacement region disposed therebetween which continuously becomes wider in the radial direction.

25. The mixer in accordance with claim 1, wherein the number of carrier elements or sheet metal carrier plates is equal to the number of swirl regions generated; and/or wherein the mixer is designed in two parts in that it can be assembled or is assembled from two sheet metal parts which are correspondingly folded over or folded to form the swirl elements, the radial displacement elements and the carrier elements; and/or wherein the mixer comprises viewed in the installed state of the mixer, means for fluid drop distribution and/or means for reinforcing the portions of the fluid spray distribution; and/or wherein the mixer comprises downwardly viewed in the installed state of the mixer, means for fluid drop distribution and/or means for reinforcing the portions of the fluid spray distribution; and/or wherein, to maintain the swirl structure generated, the mixer comprises at least one separation element arranged downstream which is separate from the multi-swirl region and from the at least one radial displacement region.

26. The mixer in accordance with claim 1, wherein the swirl elements having the shape of a vane comprise a plurality of swirl elements having the shape of a flat plate structure extending at an angle transverse to the axial exhaust gas flow.

* * * * *